US006783470B2

(12) United States Patent
Lee

(10) Patent No.: US 6,783,470 B2
(45) Date of Patent: Aug. 31, 2004

(54) GOLF TEE

(76) Inventor: Hyung Choon Lee, 86-18, Dodang-dong, Wonmigu-gu, Bucheonsi, Kyungki-do, 420-803 (KR)

( * ) Notice: Subject to any disclaimer, the term of this patent is extended or adjusted under 35 U.S.C. 154(b) by 0 days.

(21) Appl. No.: 10/244,413

(22) Filed: Sep. 17, 2002

(65) Prior Publication Data

US 2003/0181262 A1 Sep. 25, 2003

(30) Foreign Application Priority Data

Mar. 20, 2002 (KR) ..... 2002-8247

(51) Int. Cl.[7] ..... A63B 57/00
(52) U.S. Cl. ..... 473/401; 473/396
(58) Field of Search ..... 473/387–403

(56) References Cited

U.S. PATENT DOCUMENTS 2,011,203 A * 8/1935 Seiki ..... 473/396
2,839,304 A * 6/1958 Lerick ..... 473/397
4,418,916 A * 12/1983 Matsuura ..... 473/396
4,524,974 A * 6/1985 Matsuura ..... 473/396
4,610,451 A * 9/1986 Keys ..... 473/396
4,786,054 A * 11/1988 Keys ..... 473/396
5,242,170 A * 9/1993 Ward ..... 473/396

* cited by examiner

*Primary Examiner*—Steven Wong
(74) *Attorney, Agent, or Firm*—Birch, Stewart, Kolasch & Birch, LLP

(57) ABSTRACT

The present invention provides a golf tee wherein a body (1) and a stick pin (2) for sticking to the ground are separated and formed to be connected with the clevis pin (8), a spring (7) is provided in the inner portion of the body (1), the body (1) is, upon striking of golf ball, bent in the progress direction of the golf ball, thereby a frictional resistance to the golf ball and golf tee is minimized and a light striking can be made, and further a ratio length of the golf ball can be further extended. Further, the bent body can be automatically restored in an original state and conveniently re-used.

4 Claims, 4 Drawing Sheets

GOLF TEE

EXPLANATION OF THE REFERENCE NUMERALS

Figure 1:
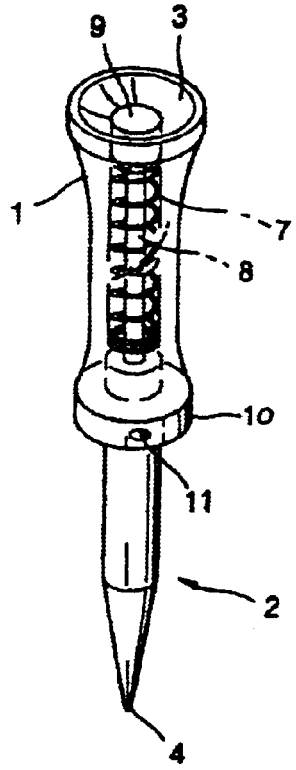
FIG. 1 is a perspective view showing a golf tee according to the present invention.

1: body
2: stick pin
3: inclined section
4: stick portion
5: combined groove
6: suspending jaw
7: spring
8: clevis pin
9: pin head
10: projecting portion
11: ring hole
12: groove portion
13: fixed projection
14: golf ball
15: ground surface

DETAILED DESCRIPTION OF INVENTION

Purpose of Invention

Technical Field to which the Invention Pertains and the Prior Art in this Filed

The present invention relates to a golf tee having an impact relaxation and a restoration function and, more particularly, to a golf tee wherein a portion sticking to ground and a portion holding up the golf ball are separated each other and elastically connected by a spring; thereby, restored in an original state while minimizing an impact upon a drive shot, the golf tee is not broken, a light shot is possible, and a ratio distance can be more extended.

Generally, a golf game starts at a tee ground, to which a golf tee is stuck to ground and the golf ball is placed on the upper edge of the tee. In such a state, a drive shot is possible.

The golf tee used herein is depressed so as to place a golf ball on the upper end, its lower end can be pointed and easily stuck to the ground, its material is made of a non-elastic material such as wood or plastic. The golf tee can be selected and used in a proper height according to the height of golfer or to the kind of golf club.

Such a conventional golf tee is made of a light material. As soon as the golf ball is struck by using a golf club, the ball receives a strong impact by a club head of golf club. For this reason, the tee is easily broken, its consumption is large, the ball is bound a far by a strong impact and apt to be lost.

Further, the golf tee has a big influence on the swing path of golf ball. The moment the golf ball is stuck by a golf club, it has an influence on a resistance by the friction of the golf ball and the upper section of golf tee, or when the golf tee is broken, it may have an influence on the path of golf ball according to the broken shape or direction. The correct striking is made in a desired position, or there is a problem that a light striking is not made.

In order to solve such problem, it is suggested that by bending the upper end of the golf tee simultaneously with striking of golf ball by a golf club, a breakage or a loss due to an impact upon striking is prevented. However, such improved golf tee does not normally receive an impact as well as the bent direction is regular. There is inconvenience that the golf tee should be met with a striking direction in advance and then stuck on the ground in a correct angle. After the first striking, the bent golf tee should be again extended and restored by hand. Therefore, there are disadvantages that it gives inconvenience in its using.

Technical Matter to be Accomplished by Invention

Therefore, the present invention has been made in an effort to solve the problems mentioned above, and an object of the present invention is to provide a golf tee wherein a light striking can be made by minimizing a resistance against golf ball upon striking of the golf ball, and a ratio length can be more extended.

Another object of the present invention is provided a golf tee that can prevent from being broken or damaged due to an impact when the ball is struck, and can prevent from being bound or lost.

Still another object of the present invention is provided a golf tee wherein the body of the bent golf tee is automatically restored simultaneously with striking of the golf ball, thereby it can be re-used as it stands and convenience of use can be increased.

Construction of Invention

To accomplish the above object, the present invention provides a golf tee which comprises: a body wherein it consists of a tube body, the inner section forms a downwardly inclined section in the inner side and a suspending jaw is formed in one end of the inside of the lower side; a stick pin wherein the upper end is inserted in the downward of the body, the lower end is pointed to form a stick portion, a combining groove is long-formed vertically from the upper middle and one end of the peripheral upper side is projected to form a ring hole on the side section; a spring which receives from the upper side of the body; and a clevis pin which is long-formed by a soft elastic material and inserted from the upper side of the body, the lower end is inserted and fixed into the combining groove of the stick pin, and a pin head is formed on the upper end to prevent a spring from leaving from the upper side of the body.

According to the present invention, when the golf ball is struck, a body and a stick pin for sticking to the ground are instantaneously separated and the body is steeply bent in the progress direction of the golf ball. The body can be prevented from being completely bound and the bent body is again erected vertically by its own elasticity of the clevis pin and the restoration power of the spring, and is again combined with the upper end portion of the stick pin by the elasticity of spring and can be re-used as it stands.

The other characteristic of the present invention is that the body is made of a transparent body and the spring and clevis pin of the inner portion can be seen through it.

This connects with setting of various colors of spring and provides various shapes of high sensitive golf tee, and can directly confirm the action relation of the inner portion in the naked eye. By doing so, the confidence to the consumer can be increased.

The concrete construction and action of the present invention are described in detail with reference to the accompanying drawings.

Figure 2:
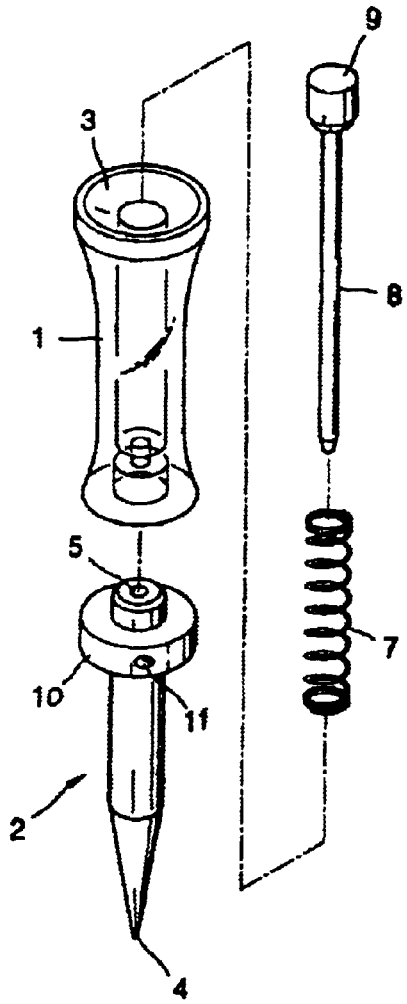
FIG. 2 is a separated perspective view showing a golf tee according to the present invention.
Figure 3:
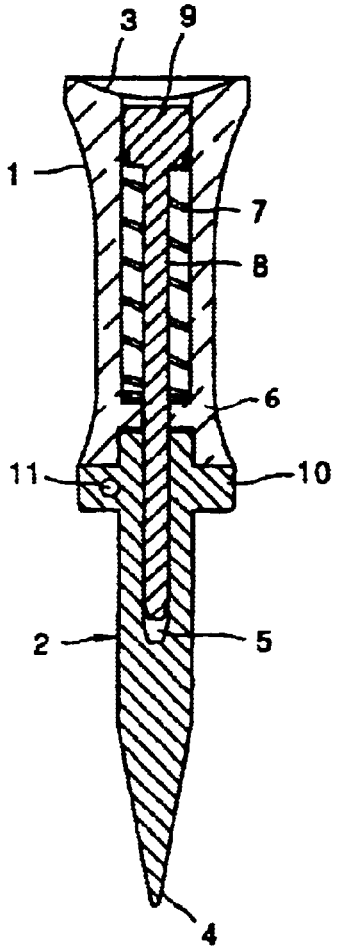
FIG. 3 is a combined cross sectional view of the present invention.
Figure 4:
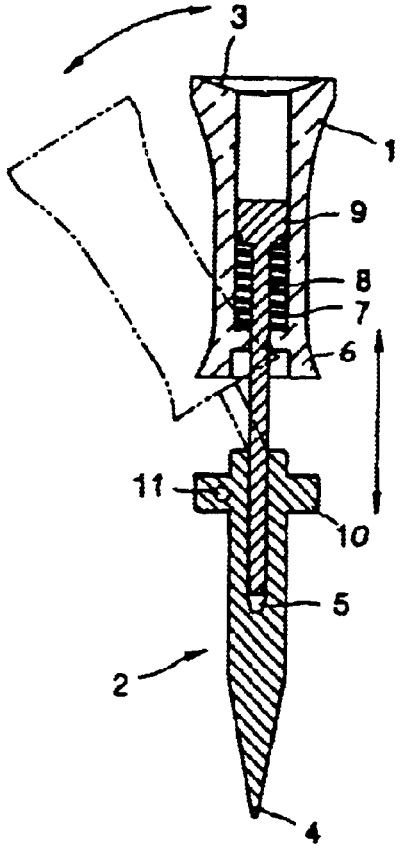
FIG. 4 is a cross sectional view showing the operation state of the present invention.

FIG. 1 is a perspective view of the present invention. FIG. 2 is a separated perspective view of the present invention. FIG. 3 is a combined cross sectional view of the present invention. Referring to FIGS. 1–3, the golf tee according to the present invention is classified into a body (1) consisting of a tube body and a stick pin (2) stuck in the downward of the body (1).

The above body (1) is designed so that the upper section forms an inclined section (3) inwardly. Therefore, the golf ball can be easily captured. The above stick pin (2) is designed so that the lower edge is pointed to provide the stick portion which can easily stick to the ground, and a combining groove (5) is formed vertically from the middle of the upper section.

Further, a suspending jaw (6) is formed in the lower inside of the body (1). This supports a spring (7) which receives from the upper side of the body (1), and the lower end of the suspending jaw (6) acts as an upper limit that the upper end of the stick pin (2) is inserted.

Such body (1) and stick pin (2) are combined through a clevis pin (8). The clevis pin (8) is inserted from the upper side of the body (1), and the lower end is inserted into the combining groove (5) of the stick pin (2), combined and fixed.

The pin head (9) is formed on the upper end of the clevis pin (8). This pin head (9) can be inserted into the inner portion of the body (1) and has a size to be suspended in the suspending jaw (6). This can prevent the body (1) from completely separating from the stick pin (2) and has a function to prevent a breakaway of spring (7). Therefore, the spring (7) is designed so that its lower end is supported by a suspending jaw (6) and its upper end is supported by a pin head (9) of the clevis pin (8).

Particularly, the clevis pin (8) consists of a material having elongation property and thus can make a proper bending, having a durability.

Further, a projecting portion (10) is formed in one edge of the upper side of the stick pin (2) to form a ring hole (11) in the side section. The ring hole (11) can be connected by inserting rope or string so that it prevents a golf tee from being bounded and lost. The both end portions of the hole are formed with diameters different from each other so that rope or string can be easily inserted.

In the other hand, the body (1) is made of a soft material and can sufficiently endure an impact to the striking. And the body (1) consists of a transparent body and thus, the inner spring can see through it.

According to the present invention having such construction, the body (1) can be moved, resisting to a spring (7) in a state supported in a clevis pin (8). The lower edge of the body (1) maintains a state combined with the upper edge of the stick pin (2) by the elasticity of spring (7). The clevis pin (8) can be bent, but is restored vertically by the elasticity soon. The body (1) and the stick pin (2) are restored in a combined state by a spring (7).

Figure 5:
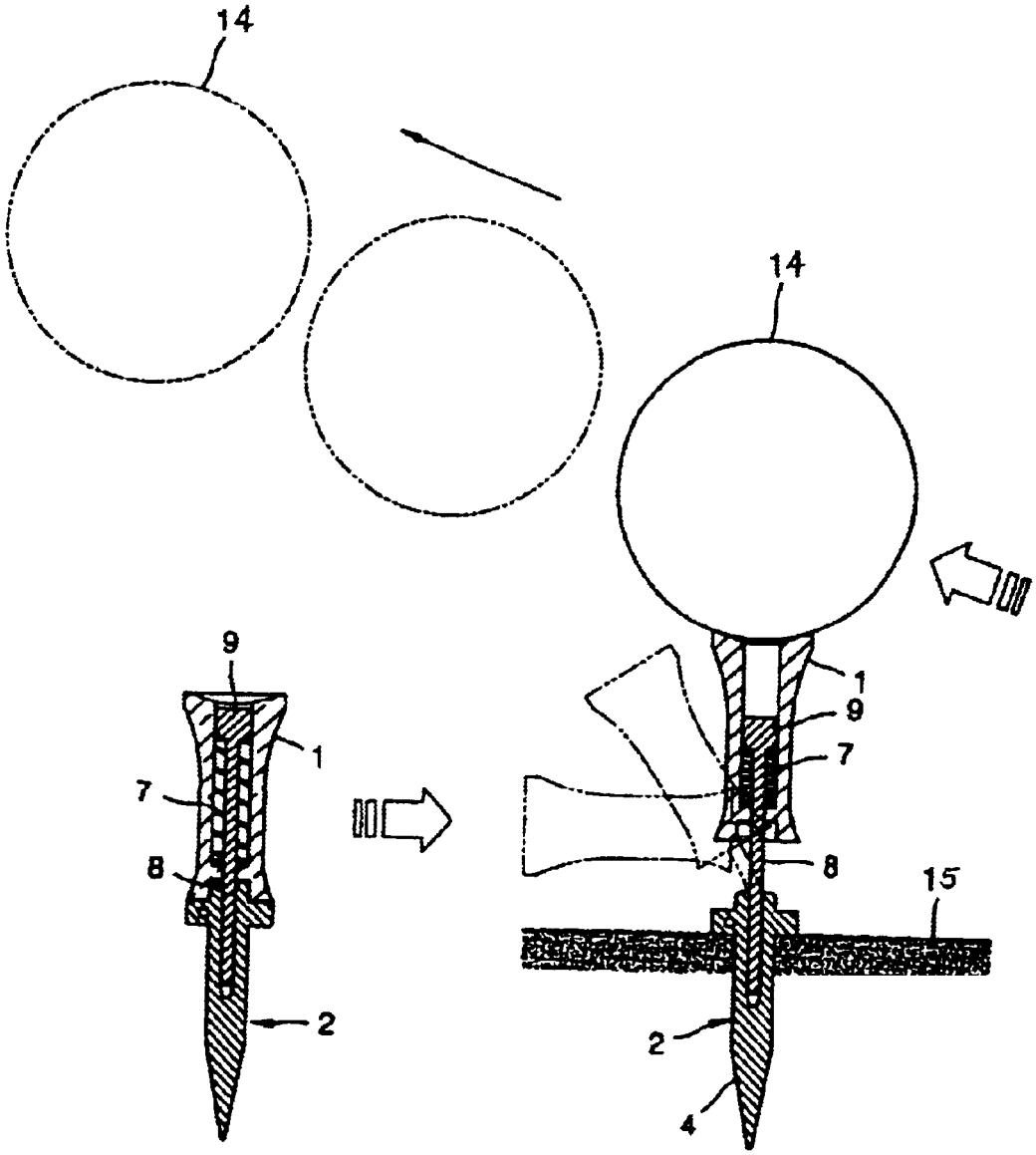
FIG. 5 shows another state of using the present invention.
Figure 6:
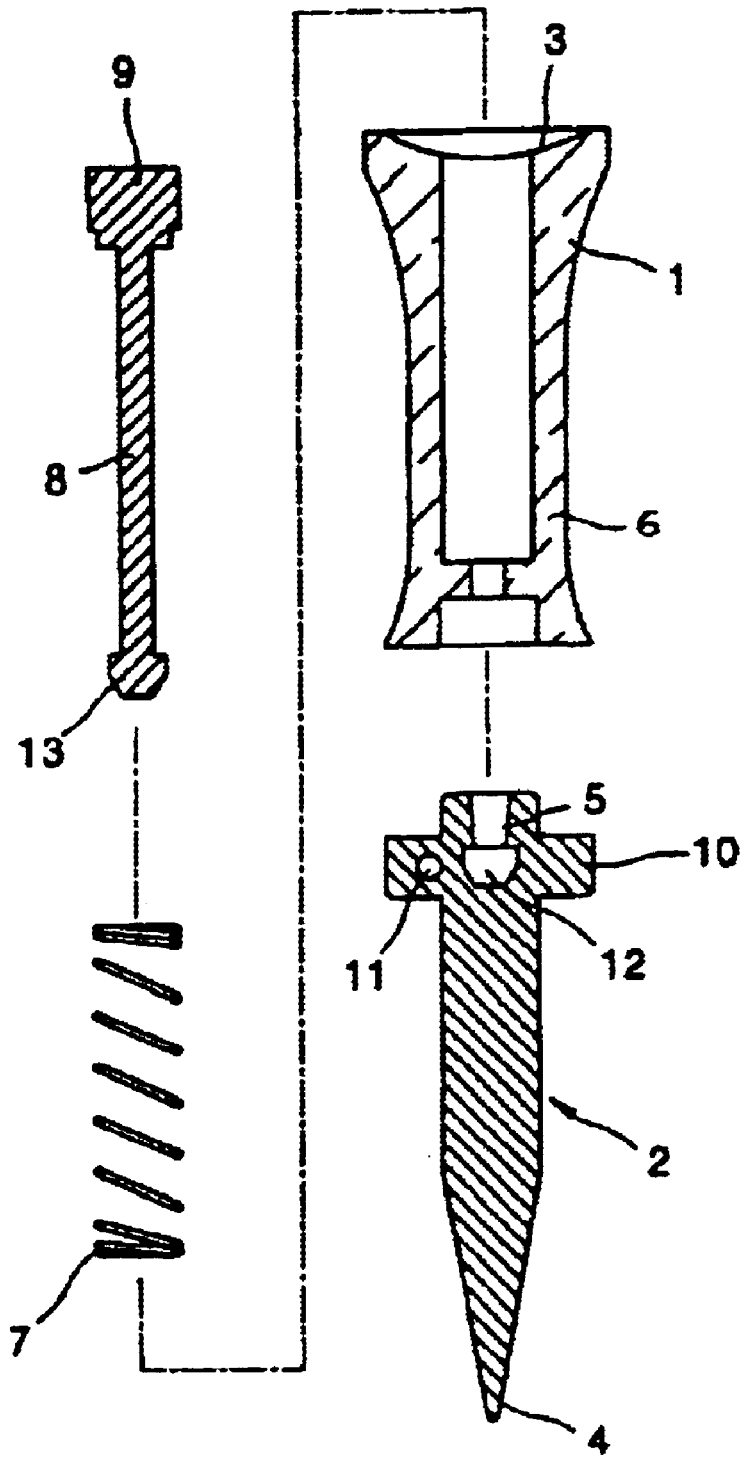
FIG. 6 is an exploded view of the golf tee.

FIG. 5 shows a state of using the present invention. In the golf tee of the present invention, the stick portion (4) of the stick pin (2) is stuck to the ground (13). The golf ball (12) is placed on the upper section of the body (1) and then a drive shot is made. At this time, the body (1) is separated from the stick pin (2) due to the impact and is steeply bent in the progress direction of the golf ball, immediately restored elastically in a vertical state by the elasticity of the spring (7) and the clevis pin (8). The body (1) and the stick pin (2) are elastically restored in a vertical state by the elasticity of the spring (7) and automatically restored in the original state.

The progress of such striking operation can minimize a frictional resistance to the progress of the golf ball (12). The moment the golf ball (12) is struck, the body (1) is steeply bent in the progress direction of the golf ball (12). Therefore, since a friction to the golf ball can be reduced, a light shot can be sensitively made and a longer ratio distance can be obtained.

The bending of the body (1) does not have a restriction in its direction. Therefore, there is no need to worry about the hitting direction and the fixing direction of the golf tee, and there is no possibility that the golf tee is broken.

When a string is inserted and connected in the ring hole (11) of the stick pin (2), it can easily be collected even if a hitting point is deviated and the golf tee is bounded out by the golf club. Further, it can remove a concern of lost.

FIG. 7 shows the other example of the present invention wherein the portions conforming to FIGS. 1–6 are used as the same numbers.

FIG. 7 shows, as the other example, a structure in which the clevis pin (8) is inserted and fixed in the combining groove (5). Referring to FIG. 7, the groove portion (12) is formed in the inside wall of the combining groove (5). The fixed and projected portion (13) that has the shape conforming to the groove portion (12) is projected and formed in the lower end of the clevis pin (8). The clevis pin (8) is pulled and inserted into the combining groove (5). The fixed projection (13) is captured in the groove portion (12) and can be stably fixed without separate adhesion process.

The clevis pin (8) has elasticity and thus, it might be inconvenient to fix it due to the pushing and inserting. The lower end of the combining groove (5) is passed through one side of the stick pin (2). The lower end of the clevis pin (8) is further extended downwardly of the fixed projection (13). When the extended portion is inserted into the combining groove (5), it is projected in one side of the stick pin (2). By doing so, the lower end of the clevis pin (8) projected in the side direction is pulled and the fixed projection (13) can be easily captured in the groove portion (12). After assemble, it is possible to cut and remove the lower edge of the clevis pin (8) projected in the side direction of the stick pin (2).

As described and shown in the above, the present invention does not intend to limit the above examples, and various change or modification can be made within the scope without deviating the technical idea of the present invention.

Effect of Invention

As set forth above, the present invention provides a golf tee wherein a body (1) and a stick pin (2) for sticking to the ground are separated and formed to be connected with the clevis pin (8), a spring (7) is provided in the inner portion of the body (1), the body (1) is, upon striking of golf ball, bent in the progress direction of the golf ball, thereby a frictional resistance to the golf ball and golf tee is minimized and a light striking can be made, and further a ratio length of the golf ball can be further extended.

The body (1) is elastically bent concurrently with striking and thus, can prevent from being broken or bounded by an impact. Therefore, the economic damage due to breakage or lost can be overcome. The bent body is automatically restored in the original state by the elasticity of the spring (7) and the clevis pin (8). Therefore, it can be conveniently re-used without a separate operation.

What is claimed is:

1. A golf tee, comprising:

a body including a tube body having an inner section which forms a downwardly inclined section in the inner side, and a suspending jaw formed in one end of the inside of the lower side;

a stick pin, wherein the upper end is inserted in the lower part of the body, the lower end is pointed to form a stick portion, a combining groove is vertically-formed vertically from the center of the upper part, and one end of the peripheral upper side is projected to form a ring hole on the side section;

a spring received by the upper side of the body; and a clevis pin which is vertically-formed by a soft elastic material, inserted from the upper side of the body, wherein the lower end of the clevis pin is inserted and fixed into the combining groove of the stick pin, and a pin head is formed on the upper end of the clevis pin to prevent the spring from leaving from the upper side of the body.

2. The golf tee according to claim 1, wherein the body is made of a transparent body.

3. The golf tee according to claim 1, wherein the ring hole of the stick pin is formed so that the diameters of the two end portions are different from each other.

4. The golf tee according to claim 1, wherein a groove portion is formed in the inside of the combining groove of the stick pin, and a fixed projection which corresponds to the groove portion is projected and formed in the lower end of the clevis pin to engage each other, so that a stable fixed state can be made.

* * * * *